US012502003B2

(12) United States Patent
Wang et al.

(10) Patent No.: US 12,502,003 B2
(45) Date of Patent: Dec. 23, 2025

(54) FOLDABLE AND ADJUSTABLE BEDS

(71) Applicant: Nisco Co., Ltd, Jiangsu (CN)

(72) Inventors: Wei Wang, Jiangsu (CN); Fahuan Zhang, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 107 days.

(21) Appl. No.: 18/372,899

(22) Filed: Sep. 26, 2023

(65) Prior Publication Data

US 2024/0008652 A1 Jan. 11, 2024

Related U.S. Application Data

(60) Continuation-in-part of application No. 17/873,286, filed on Jul. 26, 2022, which is a continuation-in-part of application No. 17/506,052, filed on Oct. 20, 2021, now Pat. No. 12,089,745, which is a division of application No. 16/747,842, filed on Jan. 21, 2020,
(Continued)

(30) Foreign Application Priority Data

Sep. 28, 2022 (CN) ..... 202222570883.2

(51) Int. Cl.
*A47C 19/12* (2006.01)
*A47C 20/04* (2006.01)

(52) U.S. Cl.
CPC ..... *A47C 20/041* (2013.01); *A47C 19/122* (2013.01)

(58) Field of Classification Search
CPC ..... A47C 20/04; A47C 20/041; A47C 19/12; A47C 19/122
See application file for complete search history.

(56) References Cited

U.S. PATENT DOCUMENTS 802,390 A * 10/1905 Gusdorf ..... A47C 19/122 5/174
2009/0094748 A1* 4/2009 Long ..... A47C 20/041 5/613

(Continued)

FOREIGN PATENT DOCUMENTS

CN 2616738 Y * 4/2003 ..... A47C 19/122
GB 383584 A * 11/1932 ..... A47C 19/122

(Continued)

*Primary Examiner* — Justin C Mikowski
*Assistant Examiner* — Ifeolu A Adeboyejo
(74) *Attorney, Agent, or Firm* — troutman pepper locke; Tim Tingkang Xia, Esq.

(57) ABSTRACT

A foldable bed includes platforms, first and second support structures for supporting the platforms, and a pair of connection mechanisms for pivotally connecting the first and second support structures such that the first and second support structures are pivotally foldable relative to one another. The first support structure has a pair of first side rails transversely spaced and longitudinally aligned; an upper rail having two ends respectfully connected to the upper ends of the pair of first side rails; and a mounting support bar connected to the pair of first side rails and being parallel to the upper rail. The second support structure has a pair of second side rails transversely spaced and longitudinally aligned; and a lower rail having two ends respectfully connected to the lower ends of the pair of second side rails.

15 Claims, 13 Drawing Sheets

Related U.S. Application Data now Pat. No. 11,178,974, which is a continuation-in-part of application No. 16/729,700, filed on Dec. 30, 2019, now Pat. No. 11,317,729.

(60) Provisional application No. 62/796,172, filed on Jan. 24, 2019, provisional application No. 62/796,154, filed on Jan. 24, 2019, provisional application No. 62/790,583, filed on Jan. 10, 2019, provisional application No. 62/789,047, filed on Jan. 7, 2019, provisional application No. 62/789,062, filed on Jan. 7, 2019.

(56) References Cited

U.S. PATENT DOCUMENTS

| | | | | |
|---|---|---|---|---|
| 2021/0022517 | A1* | 1/2021 | Bellingroth | A47C 19/005 |
| 2021/0346219 | A1* | 11/2021 | Shih | A61G 7/015 |
| 2021/0393040 | A1* | 12/2021 | Sun | A47C 19/025 |
| 2022/0117400 | A1* | 4/2022 | Zeng | A47C 19/12 |
| 2024/0057779 | A1* | 2/2024 | Koltzenburg | A47C 20/08 |

FOREIGN PATENT DOCUMENTS

| | | | | |
|---|---|---|---|---|
| TW | M574437 U | * | 2/2019 | A47C 19/122 |
| WO | WO-2021001666 | A1 * | 1/2021 | A47C 17/86 |
| WO | WO-2022088574 | A1 * | 5/2022 | A47C 19/122 |

* cited by examiner

FOLDABLE AND ADJUSTABLE BEDS

CROSS-REFERENCE TO RELATED PATENT APPLICATIONS

This application claims priority to and benefit of Chinese Patent Application Serial No. 202222570883.2, filed Sep. 28, 2022, which is incorporated herein in its entirety by reference.

This application is a continuation-in-part application of U.S. patent application Ser. No. 17/873,286, filed Jul. 26, 2022, which is a continuation-in-part application of U.S. patent application Ser. No. 17/506,052, filed Oct. 20, 2021, which is a divisional application of U.S. patent application Ser. No. 16/747,842 filed Jan. 21, 2020, now U.S. Pat. No. 11,178,974, which itself claims priority to and the benefit of U.S. Provisional Patent Application Ser. Nos. 62/796,154 filed Jan. 24, 2019 and 62/796,172 filed Jan. 24, 2019, and also is a continuation-in-part of U.S. patent application Ser. No. 16/729,700 filed Dec. 30, 2019, now U.S. Pat. No. 11,317,729, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to an ultra-thin foldable bed with adjustable functions.

BACKGROUND OF THE INVENTION

Sleep is critical for people in every aspect of their lives. Beds are necessary furniture for people to sleep on. A conventional bed usually occupies a relatively large area of the living space for people and is not convenient to carry. Thus, it is beneficial and desirable for people to have a bed system that is foldable to reduce the space for storage and transportation. In addition, it is also beneficial and desirable that the bed system can adjust body positions based on user's sleep preference so that the user achieves maximum comfort during sleep.

SUMMARY OF THE INVENTION

In one aspect, the invention relates to a foldable bed. The foldable bed includes a plurality of platforms; a support assembly comprising a first support structure and a second support structure for supporting the plurality of platforms, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails; and a pair of connection mechanisms, each connection mechanism configured to pivotally connect the lower end of one of the pair of first side rails to the upper end of a corresponding one of the pair of second side rails, such that the first support structure and the second support structure are pivotally foldable relative to one another at the pair of connection mechanisms.

In one embodiment, each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein.

In one embodiment, the notched receptacle has a width defined between the first side tab and the second side tab.

In one embodiment, each of the lower ends of the pair of first side rails and the upper ends of the pair of second side rails has a groove formed for accommodating the connection plate of each connection mechanism.

In one embodiment, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket.

In one embodiment, each connection mechanism further comprises first and second support sleeves, wherein the first support sleeve is disposed between the first side tab of the connection bracket and the inner side of the lower end of one of the pair of first side rails of the first support structure, and the second support sleeve is disposed between the second side tab of the connection bracket and the outer side of the upper end of the corresponding one of the pair of second side rails of the second support structure, so that the pair of second side rails of the second support structure is aligned between the pair of first side rails of the first support structure.

In one embodiment, the first support structure has a length, L1, defined between the upper and lower ends of the pair of first side rails and a width, W1, defined between the two ends of the upper rail, wherein the second support structure has a length, L2, defined between the upper and lower ends of the pair of second side rails and a width, W2, defined between the two ends of the lower rail, and wherein L2 is less than L1, and W2 is less than W1.

In one embodiment, the mounting support bar has a bottom portion; a first side tab and a second side tab vertically extended from two opposite ends of the bottom portion, respectively; and a first flange and a second flange vertically extended from free ends of the first side tab and the second side tab, respectively, outwardly along with the bottom portion, wherein the first flange and the second flange are respectively connected to the pair of first side rails, such that each of the first side tab and the second side tab and the inner side of the corresponding one of the pair of first side rails define a space therebetween, and when the first support structure and the second support structure are folded, each of the pair of second side rails of the second support structure is received in the corresponding space.

In one embodiment, the plurality of platforms comprises a back platform, a first seat platform, a second seat platform, a thigh platform and a leg platform, each of which having a lower edge and an upper edge, wherein the first seat platform is fixedly attached to a lower portion of the pair of the first side rails of the first support structure and the second seat platform is fixedly attached to an upper portion of the pair of the second side rails of the second support structure such that the lower edge of the first seat platform is adjacent to the upper edge of the second seat platform, and wherein the lower edge of the back platform is pivotally connected to the upper edge of the first seat platform, the upper edge of the thigh platform is pivotally connected to the lower edge of the second seat platform, and the upper edge of the leg platform is pivotally connected to the lower edge of the thigh platform.

In one embodiment, each of the plurality of platforms is a solid broad, or a net-like frame.

In one embodiment, the second support structure further comprises a pair of leg support bars, each leg support bar having one end pivotally connected to one of the pair of second side rails at its lower portion, and another end pivotally connected to the leg platform.

In one embodiment, the foldable bed further comprises a back lifting actuator pivotally connected between the mounting support bar of the first support structure and the back platform for operably driving the back platform to pivotally move in an upward rotating direction or a downward rotating direction relative to the first support structure.

In one embodiment, the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the mounting support bar of the first support structure and the second end portion of the activation rod pivotally connected to the back platform, or wherein the motor member is pivotally connected to the back platform and the second end portion of the activation rod pivotally connected to the mounting support bar of the first support structure.

In one embodiment, a reinforcement bar is provided on an underneath surface of the first seat platform and is connected to the mounting support bar.

In one embodiment, the foldable bed of further comprises a leg lifting actuator pivotally connected between the second support structure and the leg platform for operably driving the leg platform to pivotally move in an upward rotating direction or a downward rotating direction relative to the second support structure.

In one embodiment, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the lower rail of the second support structure and the second end portion of the activation rod pivotally connected to the leg platform, or wherein the motor member is pivotally connected to the leg platform and the second end portion of the activation rod pivotally connected to the lower rail of the second support structure.

In one embodiment, the foldable bed further comprises a plurality of mounting seats attached to the first support structure and the second support structure, each mounting seat has a mounting hole formed therein.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
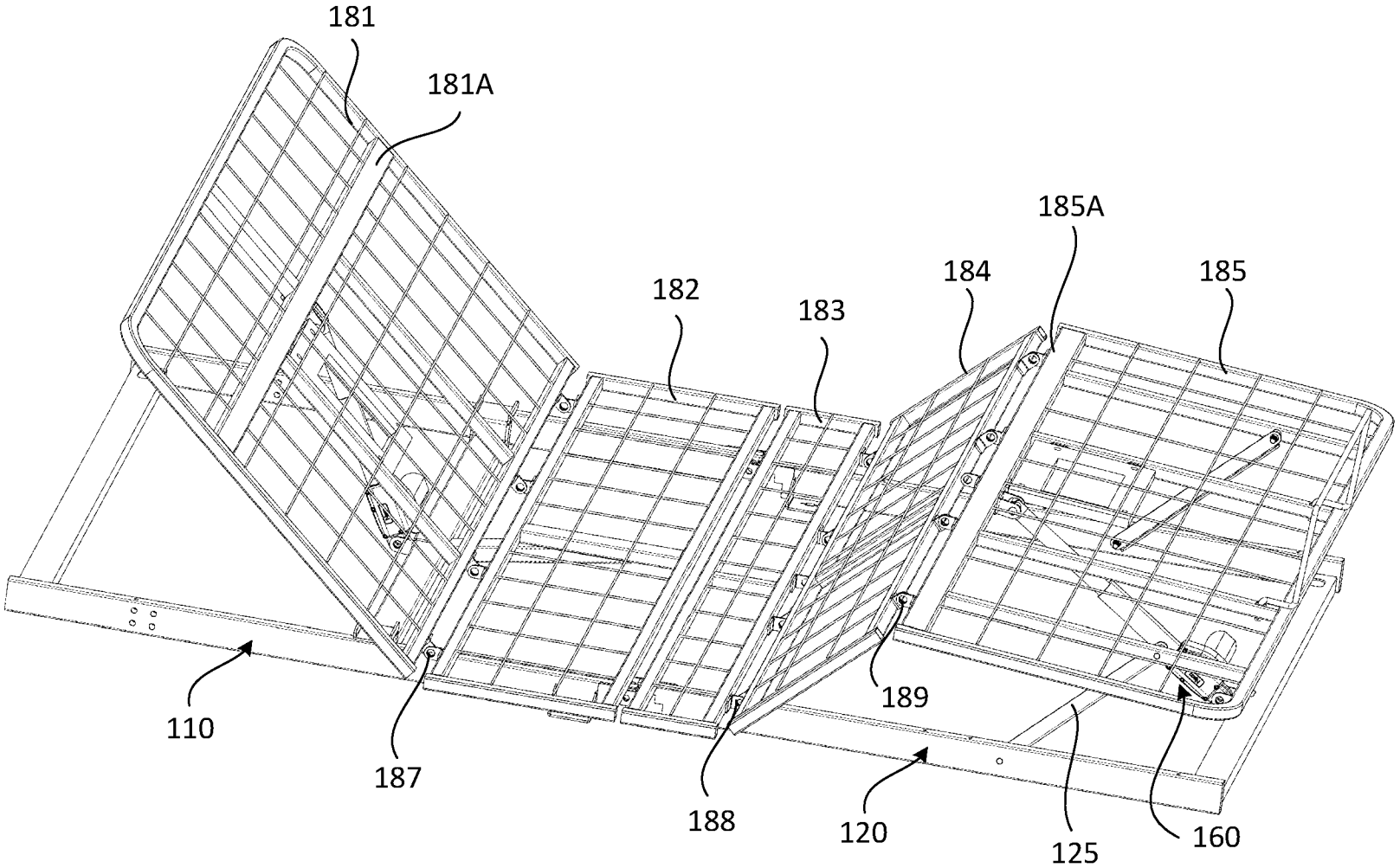
FIG. 1 shows a top perspective view of a foldable and adjustable bed with bed platforms/boards in an adjusted state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the term "board" or "platform" refers to a bed board or a bed panel.

As used in this specification, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-12. In accordance with the purposes of this invention, as embodied and broadly described herein, this invention, in one aspect, relates to a foldable and adjustable beds with foldable connection mechanisms.

Referring to FIGS. 1-12, the foldable and adjustable bed includes a plurality of platforms; a support assembly comprising a first support structure 110 and a second support structure 120 for supporting the plurality of platforms 181-185; and a pair of connection mechanisms 140 for connecting the first support structure 110 to the second support structure 120.

Figure 6A:
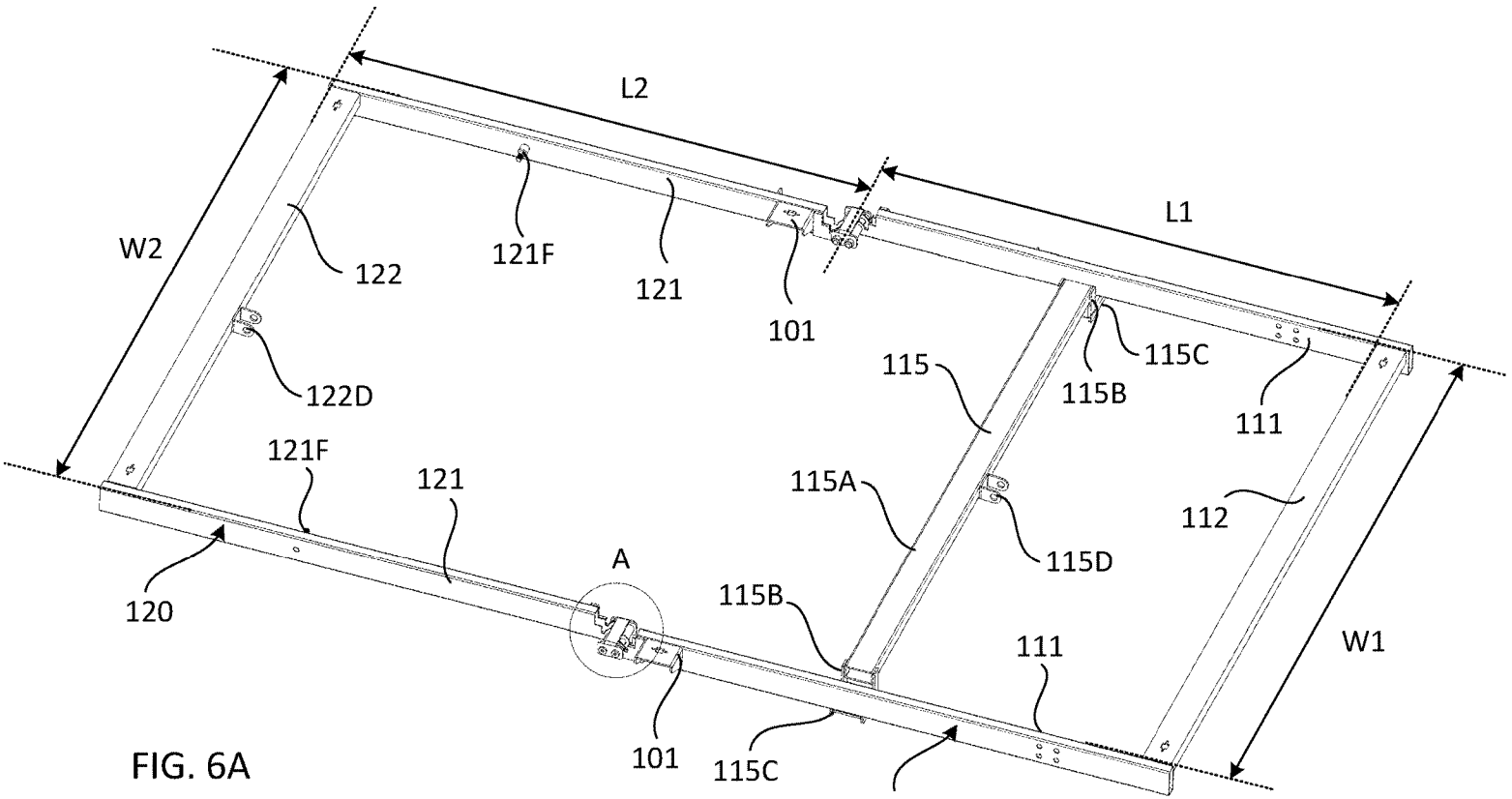
FIG. 6A shows a perspective view of a support assembly of the foldable and adjustable bed shown in FIG. 1.

As shown in FIG. 6A, the first support structure 110 has a pair of first side rails 111 transversely spaced and longitudinally aligned and each first side rail 111 having an upper end and a lower end; an upper rail 112 having two ends respectfully and fixedly connected to the upper ends of the pair of first side rails 111; and a mounting support bar 115 fixedly connected to the pair of first side rails 111 and being parallel to the upper rail 112. The second support structure 120 has a pair of second side rails 121 transversely spaced and longitudinally aligned and each second side rail 121 having an upper end and a lower end; and a lower rail 122 having two ends respectfully and fixedly connected to the lower ends of the pair of second side rails 121. The fixed connections between the first side rails 111 and the upper rail 112 of the first support structure 110 and between the second side rails 121 and the lower rail 122 of the second support structure 120 can be achieved by any fixed connection means such as welding means, molding means, screwing means, mating connections, or the likes.

Figure 2:
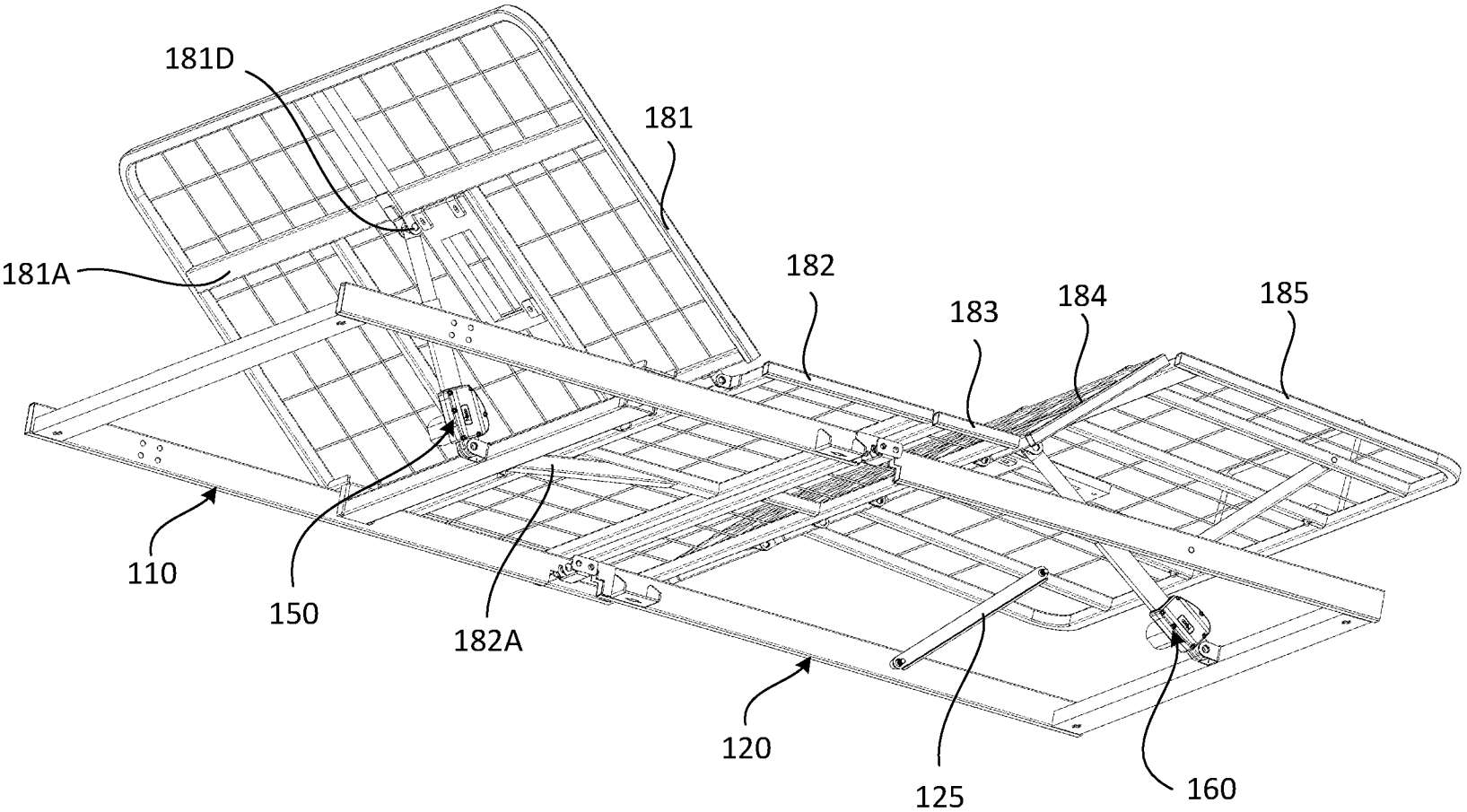
FIG. 2 shows a bottom perspective view of the foldable and adjustable bed shown in FIG. 1.
Figure 3:
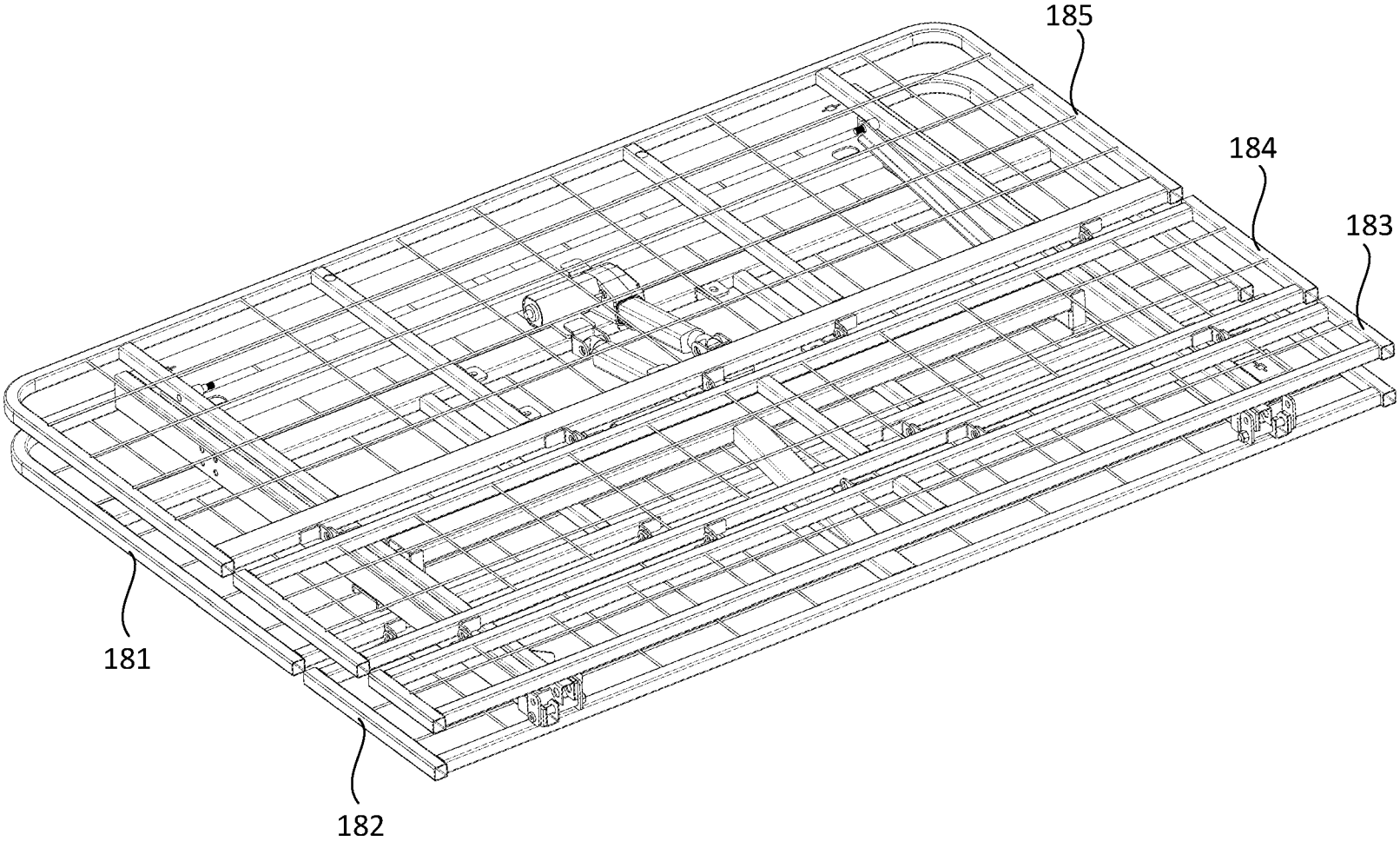
FIG. 3 shows a perspective view of the foldable and adjustable bed shown in FIG. 1 in a folded state.
Figure 4:
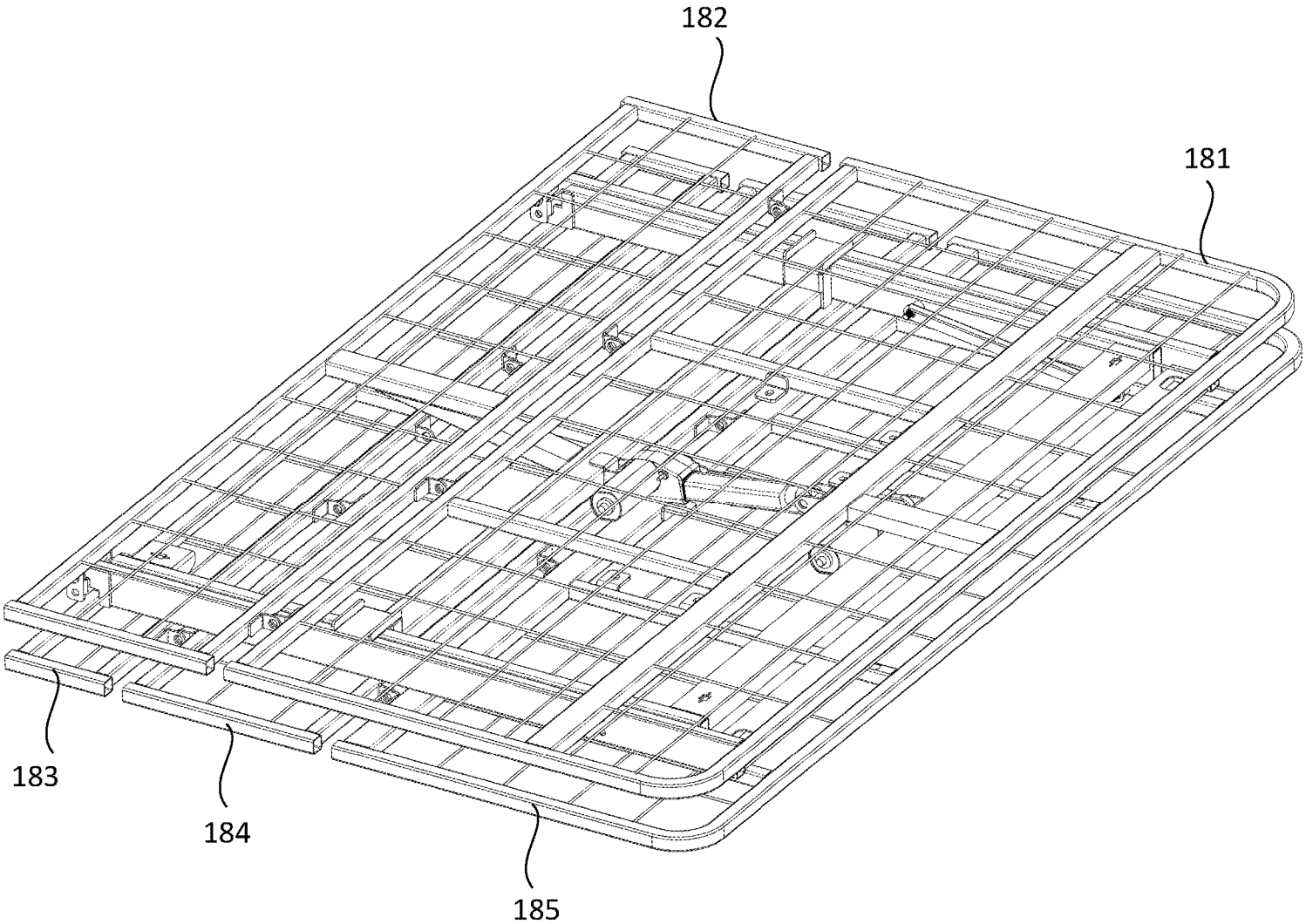
FIG. 4 shows another perspective view of the foldable and adjustable bed shown in FIG. 1 in the folded state.
Figure 5:
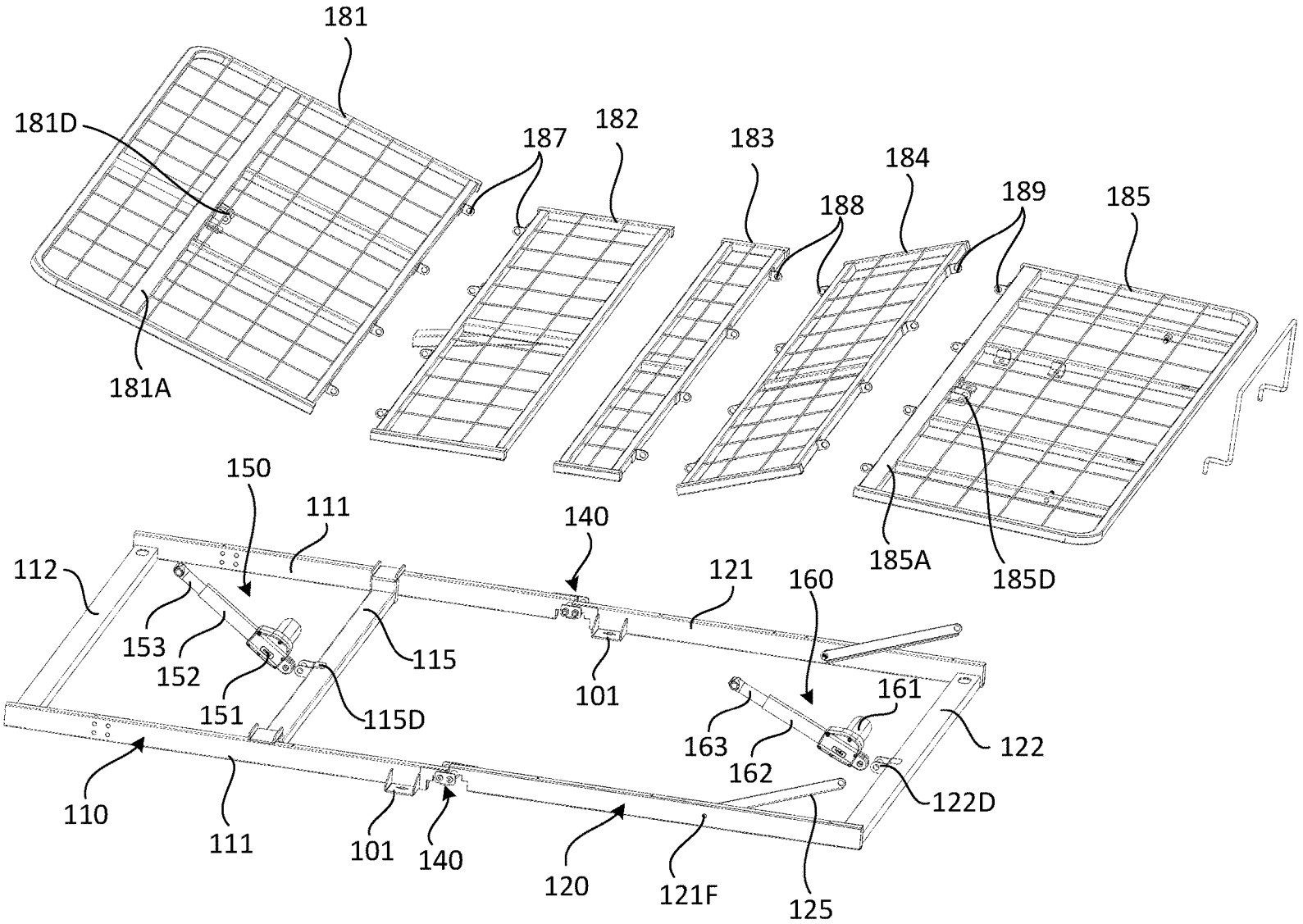
FIG. 5 shows an exploded view of the foldable and adjustable bed shown in FIG. 1.
Figure 7A:
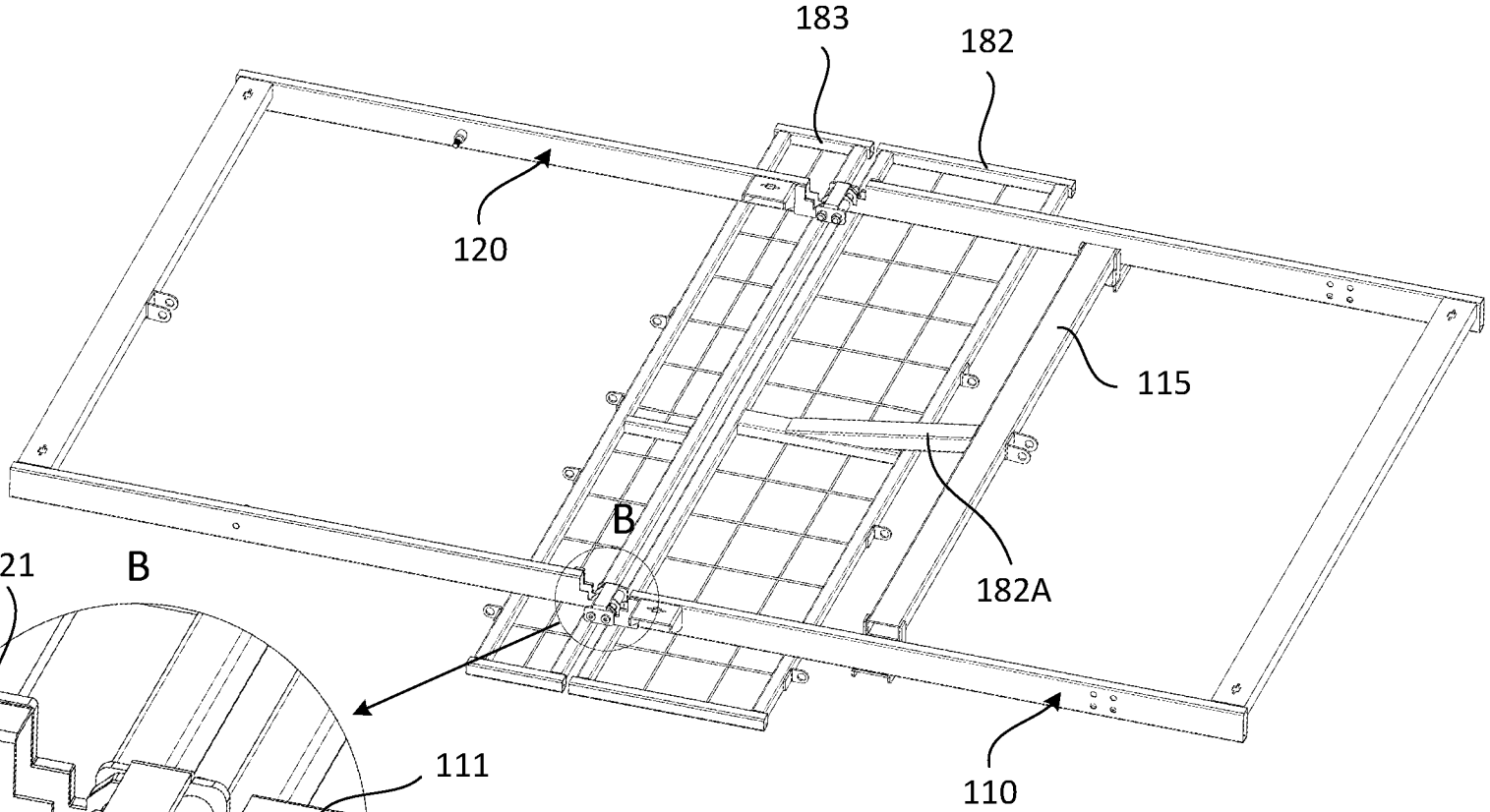
FIG. 7A shows a partially perspective view of the foldable and adjustable bed shown in FIG. 1.
Figure 7B:
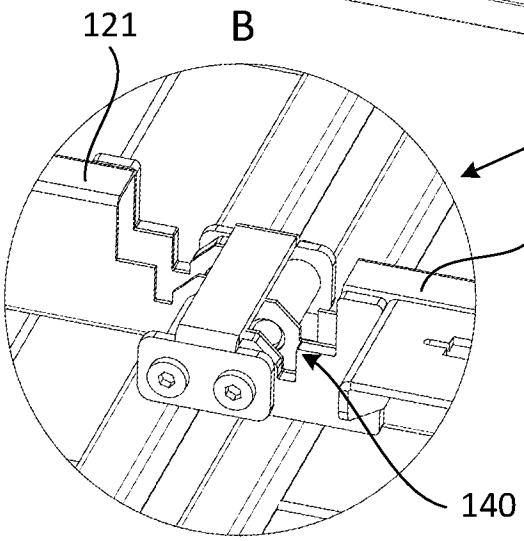
FIG. 7B shows an enlarged view of section B of the foldable and adjustable bed shown in FIG. 7A.
Figure 8:
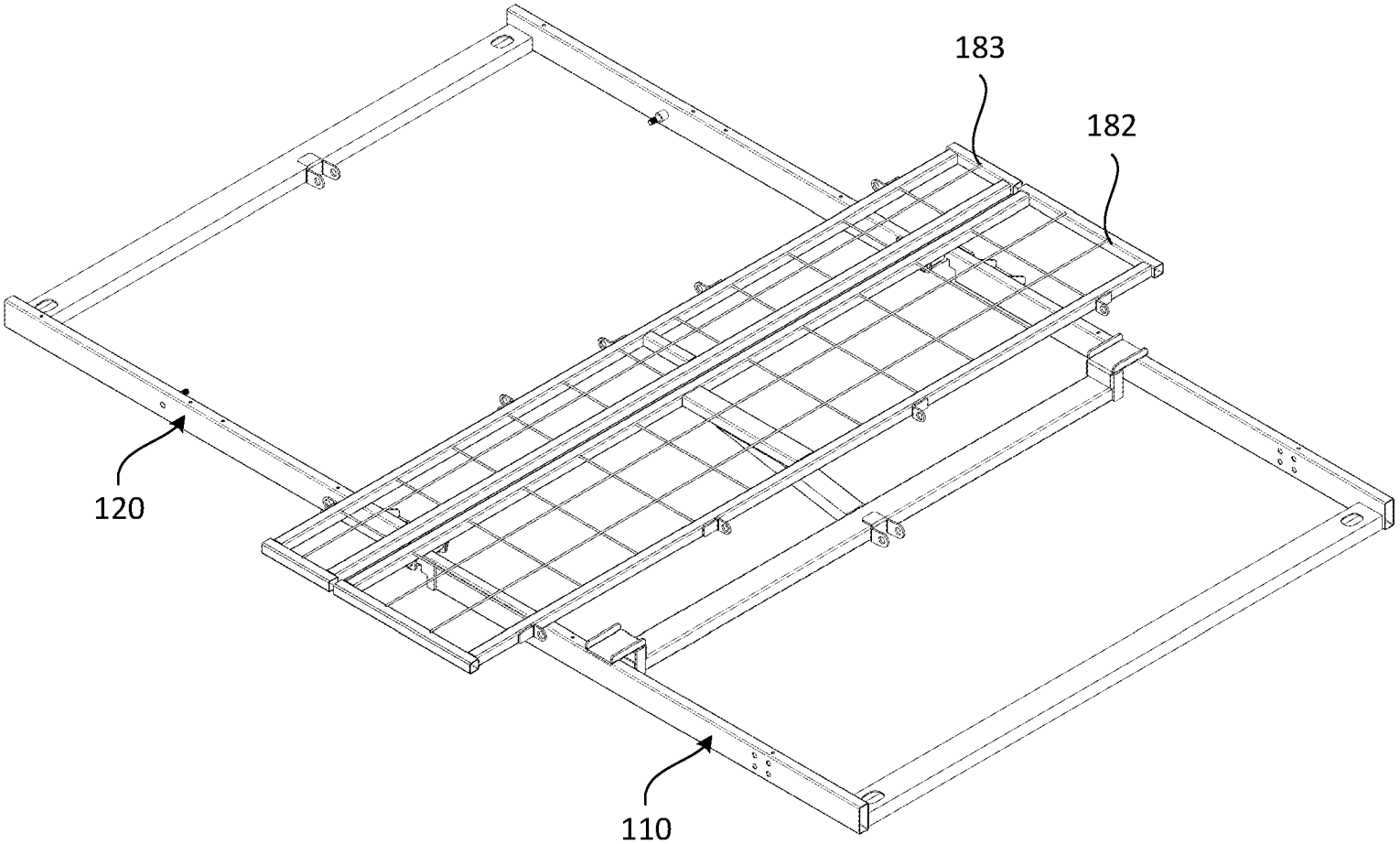
FIG. 8 shows another partially perspective view of the foldable and adjustable bed shown in FIG. 1 in a flat state.

It should be noted that, without intent to limit the scope of the invention, the relative terms "upper" and "lower" used in the disclosure refer respectively to a "left" portion/end and a "right" portion/end of an element shown in FIGS. 1-2 and 5, or a "right" portion/end and a "left" portion/end of an element shown in FIGS. 6A and 7A, depending on orientations of the foldable and adjustable bed.

Also referring to FIG. 6A, the first support structure 110 has a length, L1, defined between the upper and lower ends of the pair of first side rails 111 and a width, W1, defined between the two ends of the upper rail 112. The second support structure 120 has a length, L2, defined between the upper and lower ends of the pair of second side rails 121*c* and a width, W2, defined between the two ends of the lower rail 122. In one embodiment, L2 is less than L1, and W2 is less than W1.

Figure 6B:
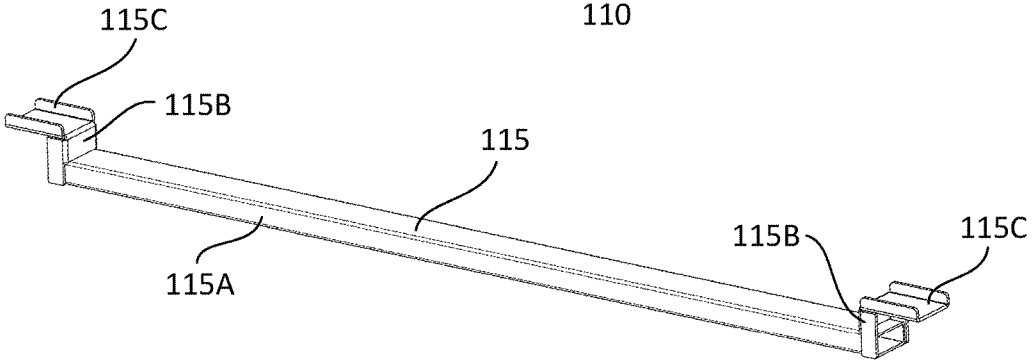
FIG. 6B shows a perspective view of a mounting support bar of the foldable and adjustable bed shown in FIG. 1.
Figure 9:
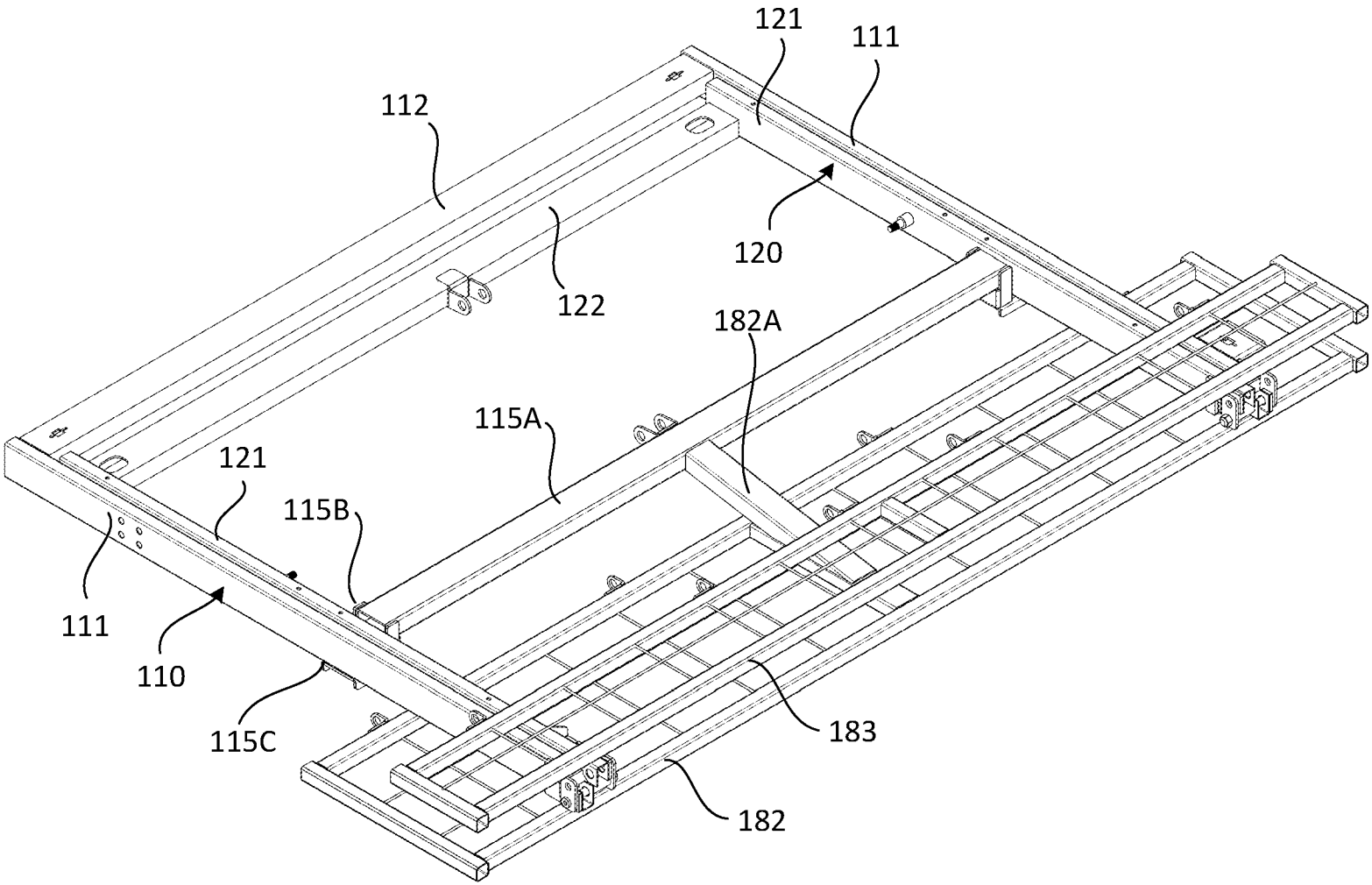
FIG. 9 show a partially perspective view of the foldable and adjustable bed shown in FIG. 1 in the folded state.
Figure 10:
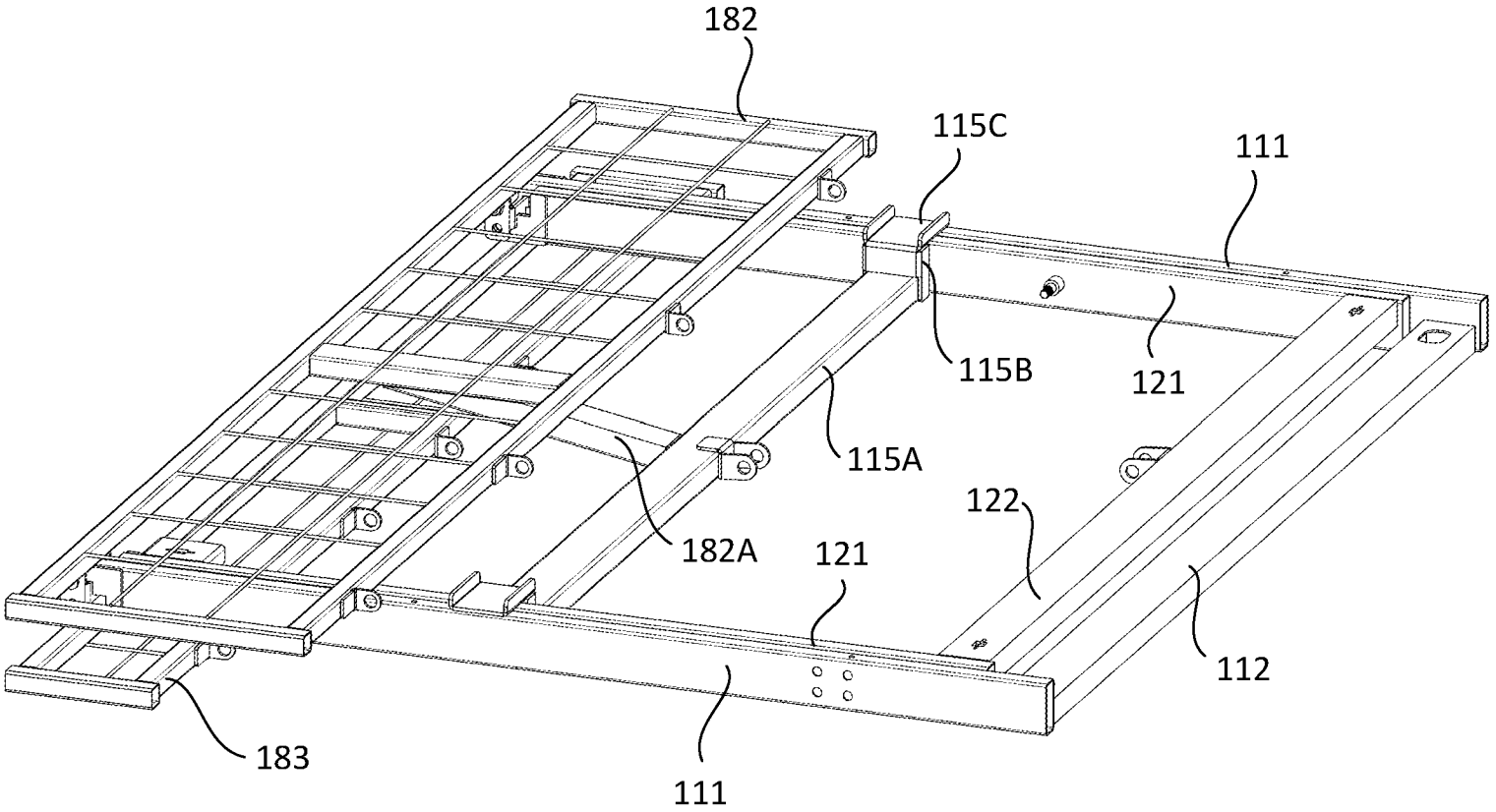
FIG. 10 show another partially perspective view of the foldable and adjustable bed shown in FIG. 1 in the folded state.

Referring to FIGS. 6B, the mounting support bar 115 has a bottom portion 115A; a first side tab 115B and a second side tab 115B vertically extended from two opposite ends of the bottom portion, 115A respectively; and a first flange 115C and a second flange 115C vertically extended from free ends of the first side tab 115B and the second side tab 115B, respectively, outwardly along with the bottom portion 115A. As shown in FIG. 6A, the first flange 115C and the second flange 115C are respectively and fixedly connected to the pair of first side rails 111, such that each of the first side tab 115B and the second side tab 115B and the inner side of the corresponding one of the pair of first side rails 111 define a space therebetween. When the first support structure 110 and the second support structure 120 are folded, each of the pair of second side rails 121 of the second support structure 120 is received in the corresponding space, as shown in FIGS. 9-10, thereby reducing the thickness of the folded bed.

Figure 6D:
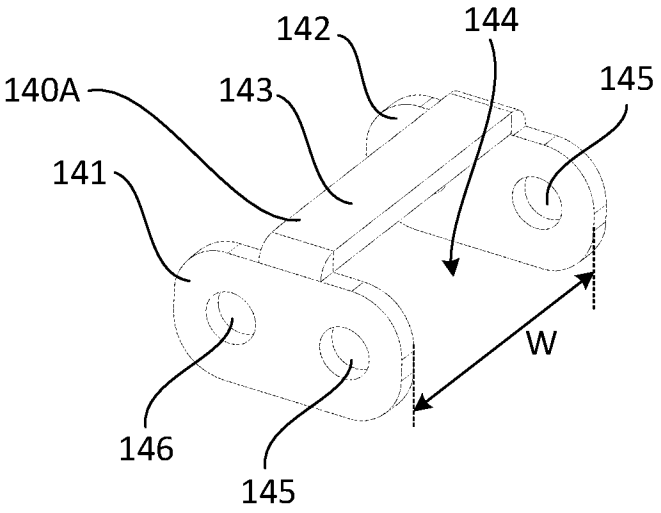
FIG. 6D shows a perspective view of a connection bracket of the foldable and adjustable bed shown in FIG. 1.
Figure 6C:
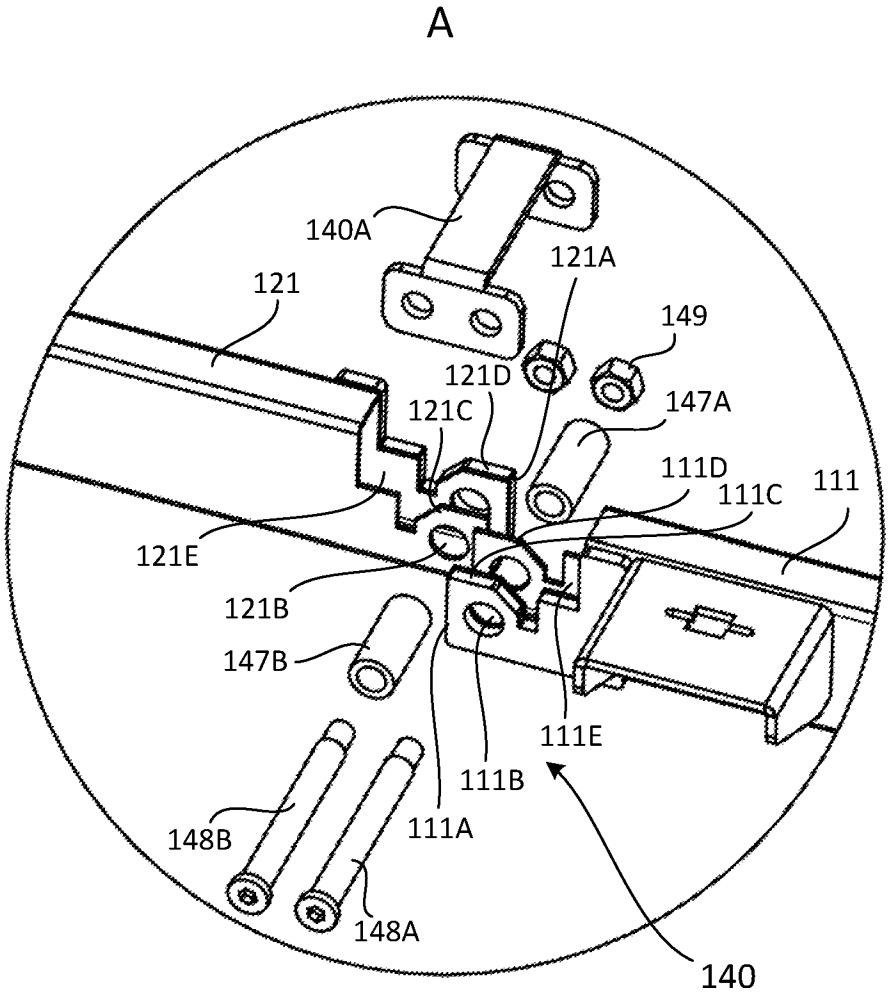
FIG. 6C shows an enlarged view of section A of the support assembly shown in FIG. 6A.

In addition, as shown in FIG. 6C, each of the lower ends 111A of the pair of first side rails 111 and the upper ends 121A of the pair of second side rails 121 has a groove 111E and 121E formed for accommodating each connection mechanism 140.

In some embodiments, each connection mechanism 140 is configured to pivotally connect the lower end of one of the pair of first side rails 111 to the upper end of a corresponding one of the pair of second side rails 121, such that the first support structure 110 and the second support structure 120 are pivotally foldable relative to one another at the pair of connection mechanisms.

In some embodiments, as shown in FIGS. 6C-6D, each connection mechanism 140 comprises a connection bracket 140A having a connection plate 143, and a first side tab 141 and a second side tab 142 vertically extended from two opposite ends of the connection plate 143 so as to define a notched receptacle 144 between the connection plate 143, the first side tab 141 and the second side tab 142. The notched receptacle 144 has a width, W, defined between the first side tab 141 and the second side tab 142. Each of the first tab 141 and the second side tab 142 has a first through hole 145 and a second through hole 146 spatial-apart formed therein.

Referring to FIG. 6C, as assembled, the lower end 111A of the first side rail 111 of the first support structure 110 is received in the notched receptacle 144 of the connection bracket 140A and pivotally connected to the connection bracket 140A through the first through holes 145 of the first and second side tabs 141 and 142 of the connection bracket 140A and the through hole 111B of the lower end 111A of the first side rail 111. The upper end 121A of the second side rail 121 of the second support structure 120 is received in the notched receptacles 144 of the connection bracket 140A and pivotally connected to the connection bracket 140A through the second through holes 146 of the first and second side tabs 141 and 142 of the connection bracket 140A and the through hole 121B of the upper end 121A of the second side rail 121.

In addition, the first and second support sleeves 147A and 147B are provided with each connection mechanism 140.

Specifically, the first support sleeve 147A is disposed between the second side tab 142 of the connection bracket 140A and the inner side 111D of the lower end 111A of the first side rail 111 of the first support structure 110. A first pin 148A is adapted to pass sequentially through the first through hole 145 of the first side tab 141 of the connection bracket 140A, the through hole 111B of the lower end 111A of the first side rail 111, the first support sleeve 147A, and the first through hole 145 of the second side tabs 142 of the connection bracket 140A, and is then secured at the second side tab 142 of the connection bracket 140A, with a nut 149, or other means, e.g., a lock pin. As such, the first side tab 141 of the connection bracket 140A is in contact with the outer side 111C of the lower end 111A of the first side rail 111, while the second side tab 142 of the connection bracket 140A is in contact with one end of the first support sleeve 147A. Preferably, the sum of the width of the lower end 111A of the first side rail 111 and the length of the first support sleeve 147A is substantially same as or very slightly less than the width W of the notched receptacles 144 of the connection bracket 140A, such that the notched receptacles 144 of the connection bracket 140A can accommodate the lower end 111A of the first side rail 111 and the first support sleeve 147A tightly therein, but still allows the lower end 111A of the first side rail 111 to rotate around the first pin 148A.

The second support sleeve 147B is disposed between the first side tab 141 of the connection bracket 140A and the outer side 121C of the upper end 121A of the second side rail 121 of the second support structure 120. A second pin 148B is adapted to pass sequentially through the second through hole 146 of the first side tabs 141 of the connection bracket 140A, the second support sleeve 147B, the through hole 121B of the upper end 121A of the second side rail 121, and the second through hole 146 of the second side tabs 142 of the connection bracket 140A, and is then secured at the second side tab 142 of the connection bracket 140A, with a nut 149, or other means, e.g., a lock pin. As such, the first side tab 141 of the connection bracket 140A is in contact with one end of the second support sleeve 147B, while the second side tab 142 of the connection bracket 140A is in contact with the inner side 121D of the upper end 121A of the second side rail 121. Preferably, the sum of the width of the upper end 121A of the second side rail 121 and the length of the second support sleeve 147B is substantially same as or very slightly less than the width W of the notched receptacles 144 of the connection bracket 140A, such that the notched receptacles 144 of the connection bracket 140A can accommodate the upper end 121A of the second side rail 121 and the second support sleeve 147B tightly therein, but still allows t the upper end 121A of the second side rail 121 to rotate around the second pin 148B.

Similarly, another first side 112 of the first support structure 110 is pivotally connected with another second side rail 122 of the second support structure 120 through another one of the pair of connection mechanisms 140.

By using the pair of connection mechanisms 140 to connect the first and second support structures 110 and 120, the first support structure 110 and the second support structure 120 are foldable to each other in a lower space below the plurality of platforms 181-185, while either the first support structure 110 or the second support structure 120 cannot rotate or be folded in an upper space above the plurality of platforms 181-185 since the connection plate 143 of each connection bracket 140A functions as a rotation limitation to prevent each of the first support structure 110 and the second support structure 120 from rotating toward the upper space above the plurality of platforms 181-185.

In addition, the pair of second side rails 121 of the second support structure 120 is aligned between the pair of first side rails 111 of the first support structure 110, as shown in FIG. 6A. When folded, each of the pair of second side rails 121 of the second support structure 120 is received in the corresponding space defined between the inner side of the first side rails 111 and the side tab 115B of the mounting support bar 115 of the first support structure 110, and the second support structure 120 is aligned inside the first support structure 110, thereby reducing the thickness of the folded bed, as shown in FIGS. 9-10.

In some embodiments, the foldable bed further comprises a plurality of mounting seats 101 attached to the first support structure 110 and the second support structure 110, each mounting seat 101 has a mounting hole formed therein. The mounting seat 101 may be used to support bed posts or bed legs (not shown).

As shown in FIGS. 1-5, the plurality of platforms includes a back platform 181, a first seat platform 182, a second seat platform 183, a thigh platform 184 and a leg platform 185, each of which has a lower edge and an upper edge. The first seat platform 182 is fixedly attached to a lower portion of the pair of the first side rails 111 of the first support structure 110 and the second seat platform 183 is fixedly attached to an upper portion of the pair of the second side rails 121 of the second support structure 120 such that the lower edge of the first seat platform 182 is adjacent to the upper edge of the second seat platform 183. The lower edge of the back platform 181 is pivotally connected to the upper edge of the first seat platform 182 through hinges 187. The upper edge of the thigh platform 184 is pivotally connected to the lower edge of the second seat platform 183 through hinges 188. The upper edge of the leg platform 185 is pivotally connected to the lower edge of the thigh platform 184 through hinges 189.

In addition, the second support structure 120 further comprises a pair of leg support bars 125. Each leg support bar 125 has one end pivotally connected to one of the pair of second side rails 121 at its lower portion 121F, and another end pivotally connected to the leg platform 185.

In some embodiments, a reinforcement bar 182A is provided on an underneath surface of the first seat platform 182 and is connected to the mounting support bar 115 of the first support structure 110, as shown in FIGS. 2 and 7A.

Figure 11:
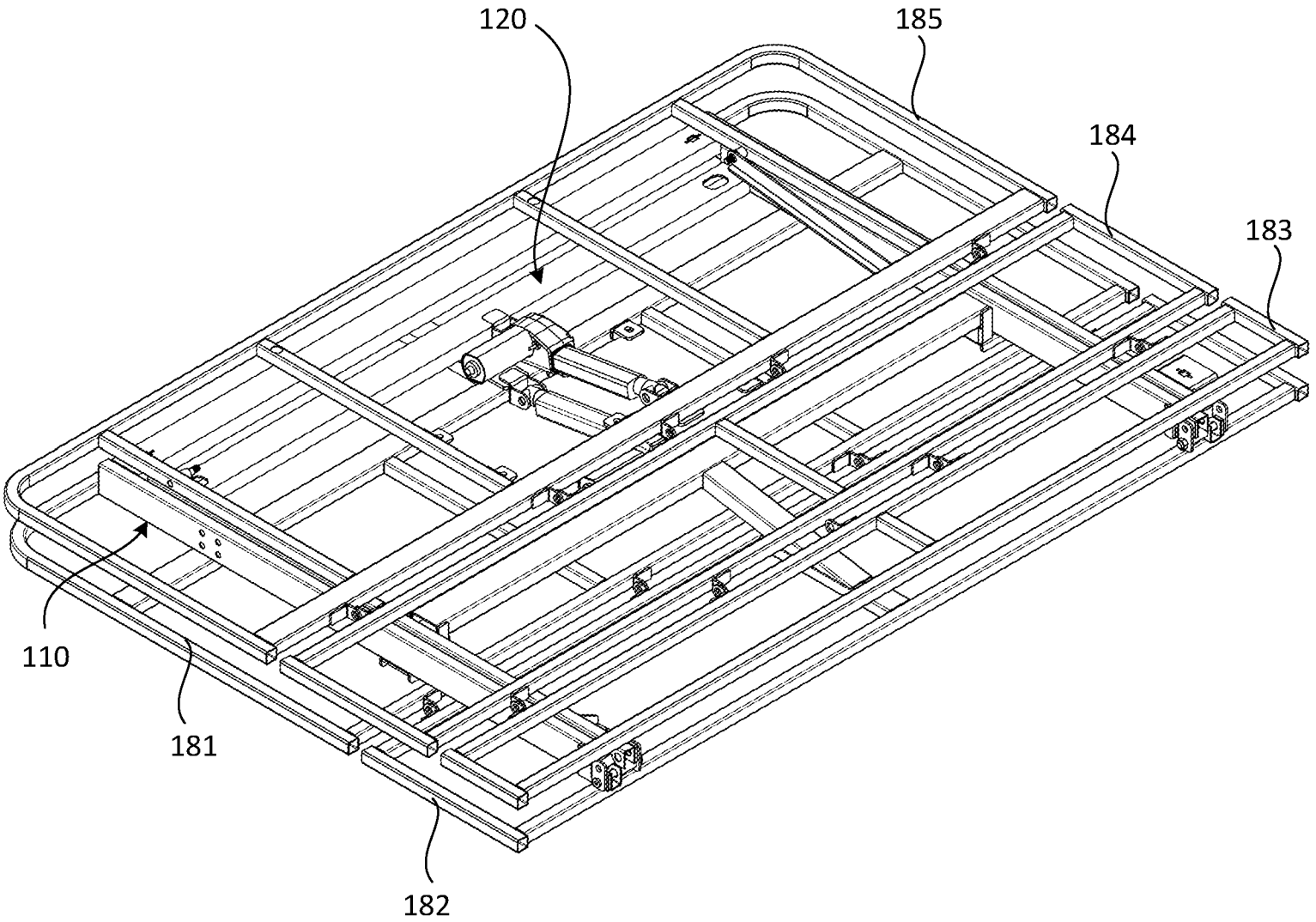
FIG. 11 show a perspective view of the foldable and adjustable bed shown in FIG. 1 in the folded state.
Figure 12:
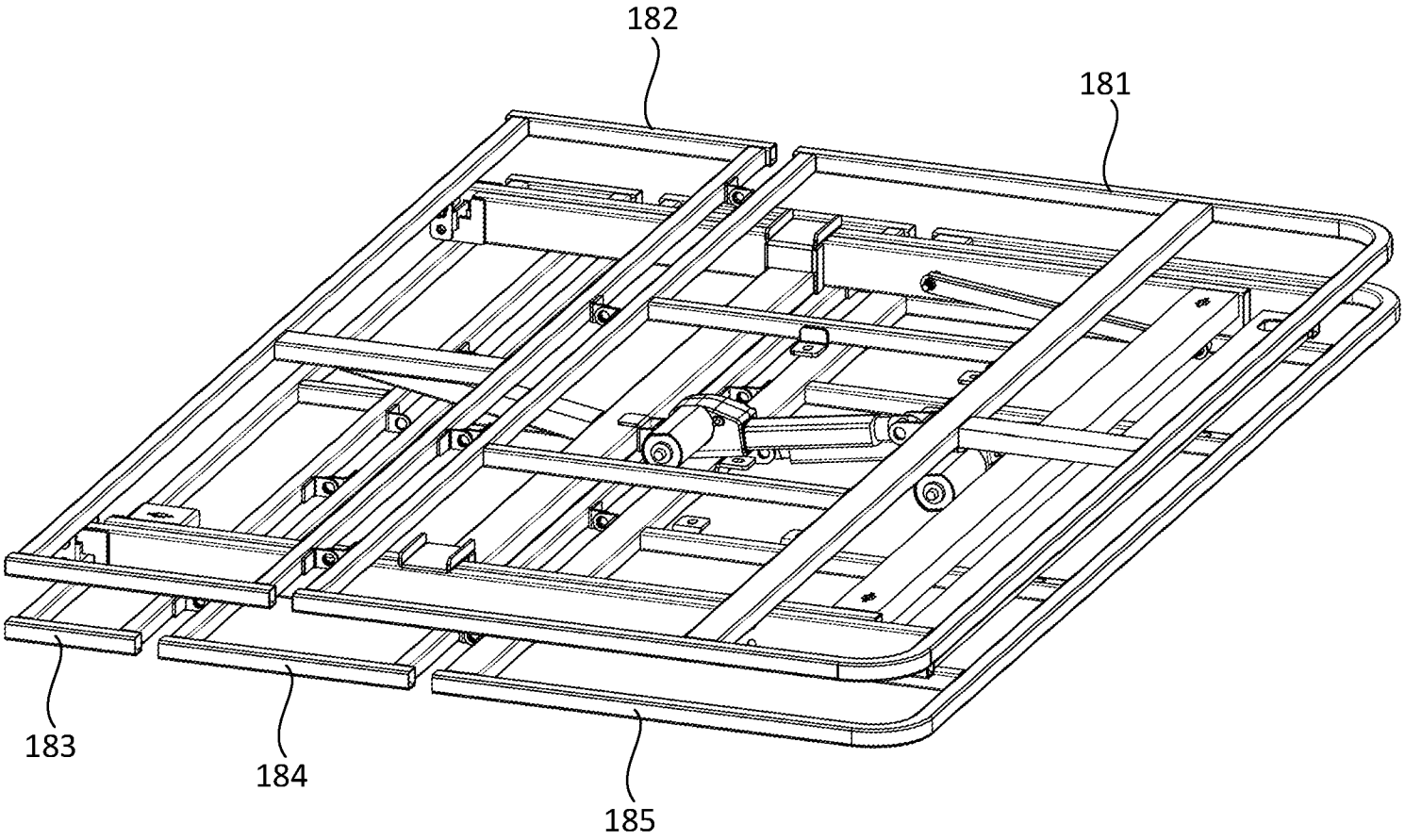
FIG. 12 show another perspective view of the foldable and adjustable bed shown in FIG. 1 in the folded state.

In some embodiments, each of the plurality of platforms is a solid broad (not shown), or a frame, as shown in FIGS. 11-13, or a net-like frame, as shown in FIGS. 1-5. The net-like frame can be a frame with threads or ropes crossly connected and/or woven to the frame.

Furthermore, the foldable bed also includes a back lifting actuator 150 pivotally connected between the mounting support bar 115 of the first support structure 110 and the back platform 181 for operably driving the back platform 181 to pivotally move in an upward rotating direction or a downward rotating direction relative to the first support structure 110.

Specifically, as shown in FIGS. 2 and 5, the back lifting actuator 150 comprises a motor member 151, an outer tube 152 extending from the motor member 151, and an activation rod 153 having a first end portion received in the outer tube 151 and an opposite, second end portion. The activation rod 153 is engaged with the motor member 151 and configured to be telescopically movable relative to the outer tube 152 according to a direction of motor rotation. In one embodiment, the motor member 151 is pivotally connected to the mounting support bar 115 of the first support structure 110 through a mounting bracket 115D and the second end portion of the activation rod 153 pivotally connected to the back platform 181 through a mounting bracket 181D on a reinforcement bar 181A formed on the underneath surface of the back platform 181. In another embodiment, the motor member 151 is pivotally connected to the back platform 181 through the mounting bracket 181D on the reinforcement bar 181A formed on the underneath surface of the back platform 181 and the second end portion of the activation rod 153 pivotally connected to the mounting support bar 115 of the first support structure 110 through the mounting bracket 115D.

By using the back lifting actuator 150, the position and angle of the back platform 181 can be adjusted according to the user's preference. For example, when the activation rod 153 is driven by the motor member 151 from a retracted state to an extended state, the back platform 181 rotates around the pivot at hinges 187 accordingly to lift up the back platform 181 from a flat position to an adjusted position (FIG. 1). Otherwise, when the activation rod 153 is driven by the motor member 151 from the extended state to the retracted state, the back platform 181 rotates around the pivot at hinges 187 accordingly to put down the back platform 181 from the adjusted position to the flat position.

Moreover, the foldable bed also includes a leg lifting actuator 160 pivotally connected between the second support structure 120 and the leg platform 185 for operably driving the leg platform 185 to pivotally move in an upward rotating direction or a downward rotating direction relative to the second support structure 185.

Also referring to FIGS. 2 and 5, the leg lifting actuator 160 comprises a motor member 161, an outer tube 162 extending from the motor member 161, and an activation rod 163 having a first end portion received in the outer tube 162 and an opposite, second end portion. The activation rod 163 is engaged with the motor member 161 and configured to be telescopically movable relative to the outer tube 162 according to a direction of motor rotation. In one embodiment, the motor member 161 is pivotally connected to the lower rail 122 of the second support structure 120 through a mounting bracket 122D and the second end portion of the activation rod 163 is pivotally connected to the leg platform 185 through a mounting bracket 185D on a reinforcement bar 185A formed on the underneath surface of the leg platform 185. In another embodiment, the motor member 161 is pivotally connected to the leg platform the leg platform 185 through the mounting bracket 185D on the reinforcement bar 185A formed on the underneath surface of the leg platform 185 and the second end portion of the activation rod 163 is pivotally connected to the lower rail 122 of the second support structure 120 through the mounting bracket 122D.

By using the leg lifting actuator 160, the position and angle of the thigh and leg platforms 184 and 185 can be adjusted according to the user's preference. For example, when the activation rod 163 is driven by the motor member 161 from a retracted state to an extended state, the leg platform 185 moves up accordingly and in turn, lifts up the thigh platform 184 from a flat position (not shown) to an adjusted position (FIG. 1). Otherwise, when the activation rod 163 is driven by the motor member 161 from the extended state to the retracted state, the leg platform 185 moves down accordingly, and in turn, puts down the thigh platform 184 from the adjusted position to the flat position.

In sum, the invention provides a bed system capable of adjusting body positions based on user's sleep preference so that the user achieves maximum comfort during sleep, and also is foldable so as to reduce the space for storage and transportation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A foldable bed, comprising:

a plurality of platforms;

a support assembly comprising a first support structure and a second support structure for supporting the plurality of platforms, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails; and a pair of connection mechanisms, each connection mechanism configured to pivotally connect the lower end of one of the pair of first side rails to the upper end of a corresponding one of the pair of second side rails, such that the first support structure and the second support structure are pivotally foldable relative to one another at the pair of connection mechanisms, wherein each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein; and wherein each of the lower ends of the pair of first side rails and the upper ends of the pair of second side rails has a groove formed for accommodating the connection plate of each connection mechanism.

2. The foldable bed of claim 1, wherein the notched receptacle has a width defined between the first side tab and the second side tab.

3. The foldable bed of claim 1, wherein, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket.

4. A foldable bed, comprising:

a plurality of platforms;

a support assembly comprising a first support structure and a second support structure for supporting the plurality of platforms, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails; and a pair of connection mechanisms, each connection mechanism configured to pivotally connect the lower end of one of the pair of first side rails to the upper end of a corresponding one of the pair of second side rails, such that the first support structure and the second support structure are pivotally foldable relative to one another at the pair of connection mechanisms, wherein each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein;

wherein, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket; and wherein each connection mechanism further comprises first and second support sleeves, wherein the first support sleeve is disposed between the first side tab of the connection bracket and the inner side of the lower end of one of the pair of first side rails of the first support structure, and the second support sleeve is disposed between the second side tab of the connection bracket and the outer side of the upper end of the corresponding one of the pair of second side rails of the second support structure, so that the pair of second side rails of the second support structure is aligned between the pair of first side rails of the first support structure.

5. The foldable bed of claim 1, wherein the first support structure has a length, L1, defined between the upper and lower ends of the pair of first side rails and a width, W1, defined between the two ends of the upper rail, wherein the second support structure has a length, L2, defined between the upper and lower ends of the pair of second side rails and a width, W2, defined between the two ends of the lower rail, and wherein L2 is less than L1, and W2 is less than W1.

6. A foldable bed, comprising:

a plurality of platforms;

a support assembly comprising a first support structure and a second support structure for supporting the plurality of platforms, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails; and a pair of connection mechanisms, each connection mechanism configured to pivotally connect the lower end of one of the pair of first side rails to the upper end of a corresponding one of the pair of second side rails, such that the first support structure and the second support structure are pivotally foldable relative to one another at the pair of connection mechanisms, wherein the first support structure has a length, L1, defined between the upper and lower ends of the pair of first side rails and a width, W1, defined between the two ends of the upper rail, wherein the second support structure has a length, L2, defined between the upper and lower ends of the pair of second side rails and a width, W2, defined between the two ends of the lower rail, and wherein L2 is less than L1, and W2 is less than W1; and wherein the mounting support bar has a bottom portion; a first side tab and a second side tab vertically extended from two opposite ends of the bottom portion, respectively; and a first flange and a second flange vertically extended from free ends of the first side tab and the second side tab, respectively, outwardly along with the bottom portion, wherein the first flange and the second flange are respectively connected to the pair of first side rails, such that each of the first side tab and the second side tab and the inner side of the corresponding one of the pair of first side rails define a space therebetween, and when the first support structure and the second support structure are folded, each of the pair of second side rails of the second support structure is received in the corresponding space.

7. The foldable bed of claim 1, wherein the plurality of platforms comprises a back platform, a first seat platform, a second seat platform, a thigh platform and a leg platform, each of which having a lower edge and an upper edge, wherein the first seat platform is fixedly attached to a lower portion of the pair of the first side rails of the first support structure and the second seat platform is fixedly attached to an upper portion of the pair of the second side rails of the second support structure such that the lower edge of the first seat platform is adjacent to the upper edge of the second seat platform, and wherein the lower edge of the back platform is pivotally connected to the upper edge of the first seat platform, the upper edge of the thigh platform is pivotally connected to the lower edge of the second seat platform, and the upper edge of the leg platform is pivotally connected to the lower edge of the thigh platform.

8. The foldable bed of claim 7, wherein each of the plurality of platforms is a solid broad, or a net-like frame.

9. The foldable bed of claim 7, wherein the second support structure further comprises a pair of leg support bars, each leg support bar having one end pivotally connected to one of the pair of second side rails at its lower portion, and another end pivotally connected to the leg platform.

10. The foldable bed of claim 7, further comprising a back lifting actuator pivotally connected between the mounting support bar of the first support structure and the back platform for operably driving the back platform to pivotally move in an upward rotating direction or a downward rotating direction relative to the first support structure.

11. The foldable bed of claim 10, wherein the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the mounting support bar of the first support structure and the second end portion of the activation rod is pivotally connected to the back platform, or wherein the motor member is pivotally connected to the back platform and the second end portion of the activation rod pivotally connected to the mounting support bar of the first support structure.

12. The foldable bed of claim 11, wherein a reinforcement bar is provided on an underneath surface of the first seat platform and is connected to the mounting support bar.

13. The foldable bed of claim 7, further comprising a leg lifting actuator pivotally connected between the second support structure and the leg platform for operably driving the leg platform to pivotally move in an upward rotating direction or a downward rotating direction relative to the second support structure.

14. The foldable bed of claim 13, wherein the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the lower rail of the second support structure and the second end portion of the activation rod pivotally connected to the leg platform, or wherein the motor member is pivotally connected to the leg platform and the second end portion of the activation rod pivotally connected to the lower rail of the second support structure.

15. The foldable bed of claim 1, further comprising a plurality of mounting seats attached to the first support structure and the second support structure, each mounting seat has a mounting hole formed therein.

* * * * *